US007273329B2

(12) United States Patent
Spratt et al.

(10) Patent No.: US 7,273,329 B2
(45) Date of Patent: Sep. 25, 2007

(54) HYDRAULIC BOAT LIFT

(76) Inventors: Steven L. Spratt, 2492 Weatherford Dr., Deltona, FL (US) 32738; Jeff C. Peters, 215 Azalea St., Tavemier, FL (US) 33070

( * ) Notice: Subject to any disclaimer, the term of this patent is extended or adjusted under 35 U.S.C. 154(b) by 68 days.

(21) Appl. No.: 11/324,955

(22) Filed: Jan. 3, 2006

(65) Prior Publication Data

US 2006/0147269 A1 Jul. 6, 2006

Related U.S. Application Data

(60) Provisional application No. 60/641,107, filed on Jan. 3, 2005.

(51) Int. Cl.
*B63C 3/06* (2006.01)

(52) U.S. Cl. ..... 405/3; 114/44; 414/678

(58) Field of Classification Search ..... 405/1, 405/3; 114/44; 414/678
See application file for complete search history.

(56) References Cited

U.S. PATENT DOCUMENTS 3,753,355 A 8/1973 Knoch
4,895,479 A 1/1990 Michaelsen et al.
5,184,914 A 2/1993 Basta
5,275,505 A * 1/1994 Wilcox ..... 405/3
5,485,798 A * 1/1996 Samoian et al. ..... 114/44
5,908,264 A * 6/1999 Hey ..... 405/3
5,919,000 A 7/1999 Unkle
6,837,651 B1 * 1/2005 Basta ..... 405/3

* cited by examiner

*Primary Examiner*—Frederick L. Lagman
(74) *Attorney, Agent, or Firm*—Elsie C. Turner

(57) ABSTRACT

An improved boat lift with an hydraulically-powered jack is provided with a locking mechanism, not only for maintaining the lift in its raised position when water pressure in the jack cylinder is released, but also to make it difficult or impossible to unlock by a potential thief or vandal. In accordance with the present invention, this object is achieved by providing a pawl member that engages a recess in the piston shaft that can be removed only with water pressure applied through an attached hose. Access to the water supply should be restricted for purposes of security. The pawl member is attached by a pivoting flap to the end of the cylinder from which the piston emerges. The flap has a flat underside so that water pressure directed against it will easily dislodge it from a recess.

6 Claims, 5 Drawing Sheets

HYDRAULIC BOAT LIFT

Applicant claims the benefit of an earlier-filed provisional application, Ser. No. 60/641,107, Filed Jan. 3, 2005.

BACKGROUND OF THE INVENTION

The present invention relates to hydraulic lifts for watercraft. The prior art includes a number of hydraulic boat lifts. U.S. Pat. No. 5,184,914 to Basta discloses a lift with pivoting booms supported on a rectangular base submerged in water. A boat support frame is attached to the pivoting booms. A double-acting hydraulic jack, a cylinder with piston, swings the booms upwardly to raise a boat out of the water. When the piston is retracted into the cylinder, the booms swing downwardly to lower the boat into the water. This invention does not rely on locking the piston in an extended position so that the lifting booms stay upright even if pressure is lost in the hydraulic jack, but rather uses canted braces engaging one of the lifting booms in an upright position so as to hold a boat up out of the water. U.S. Pat. No. 5,919,000 to Unkle also employs an hydraulic cylinder and piston combination to swing pivoting lifting elements up or down. Unkle relies on a pawl member which engages recesses in the piston shaft to lock it in an extended position in the event pressure in the cylinder is lost. A cord attached to the pawl is used to remove it from a recess so that the piston can retract into the cylinder when it is drained of water. Unkle also has adjustable vertical legs and feet. U.S. Pat. No. 4,895,479 to Michaelsen is yet another lift using an hydraulic cylinder and piston combination, pivoting lifting elements, and a locking mechanism using a compression spring to bias a pawl against the piston shaft.

None of these inventions addresses the issue of deliberate and unwanted lowering of a boat lift in order to steal the boat supported thereon. Accordingly there is a need for a locking device that can be released only by a legitimate user.

SUMMARY OF THE INVENTION

The principal object of the present invention is to provide a hydraulically-powered boat lift with a locking mechanism not only for maintaining the lift in its raised position when water pressure in the jack cylinder is released, but also to make it difficult or impossible to unlock by a potential thief or vandal. In accordance with the present invention, this object is achieved by providing a pawl member that engages a recess in the piston shaft that can be removed only with water pressure applied through attached hose. Access to water supply should be restricted for purposes of security. The pawl member is attached by a pivoting flap to the end of the cylinder from which the piston emerges. The flap has a flat underside so that water pressure directed against it will easily dislodge it from a recess.

BRIEF DESCRIPTION OF THE PREFERRED EMBODIMENT

DETAILED DESCRIPTION OF THE PREFERRED EMBODIMENT

Figure 1:
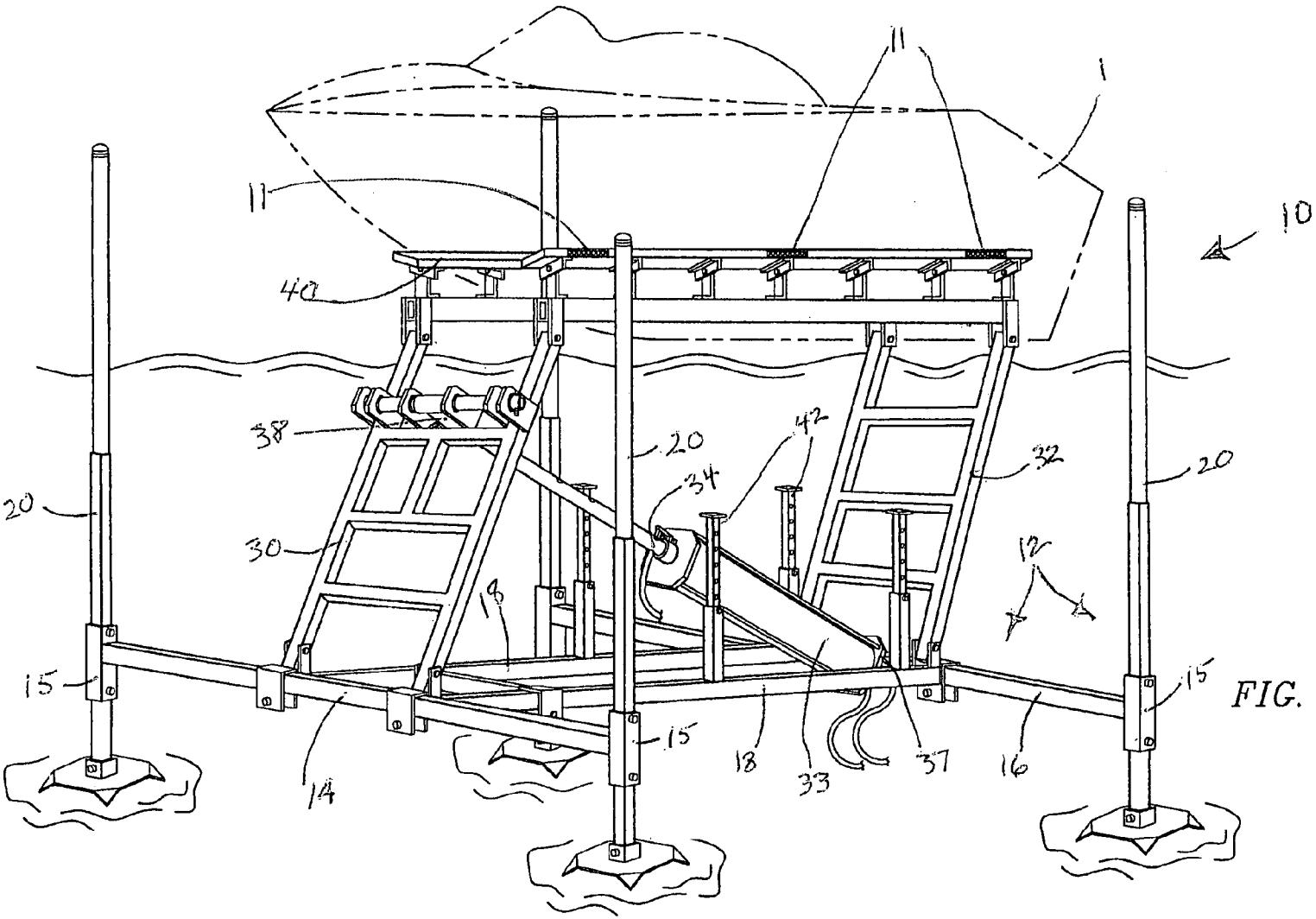
FIG. 1 is a perspective view of my improved hydraulic boat lift in a raised position, supporting a boat, shown in phantom, out of the water.
Figure 2:
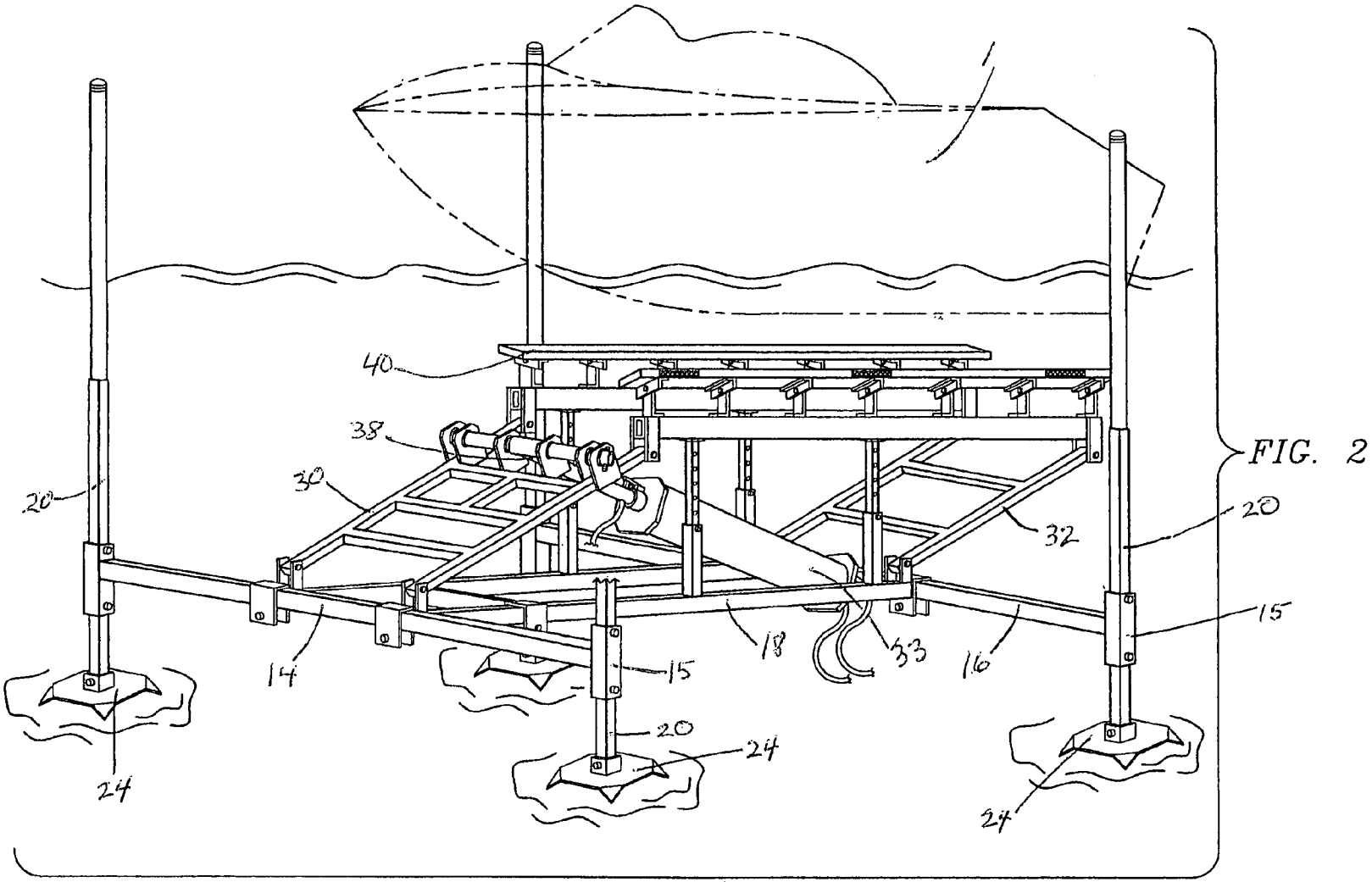
FIG. 2 is a perspective view of the invention in a lowered position beneath a floating boat shown in phantom.

Referring to FIGS. 1 and 2, the improved hydraulic boat lift of the invention 10 comprises a base framework 12 comprised of a forward crossbeam 14, an aft crossbeam 16, joined together by a pair of longitudinal beams 18, forward lifting framework 30 and an aft lifting framework 32 that pivot between a lowered position, as in FIG. 2, and a raised position as in FIG. 1. Base framework 12 is adjustably supported on four vertical legs 20. The lifting mechanism of this invention is a conventional hydraulic cylinder 33 and piston 34 combination, the base 37 of which is pivotably mounted on the aft crossbeam 16, and the distal end 38 of the piston shaft being rotatably attached to the forward lifting framework 30.

In FIG. 1, a boat 1 rests in cradle member 40 which is pivotably attached to lifting frameworks 30 and 32. Manually adjustable stops 42 rise vertically from longitudinal beams 18 to prevent cradle member 40 from being lowered below a selected depth under water. The advantage of the stops is that a boat supported by the lift 10 will not fill up with water if it has a leak.

Figure 5:
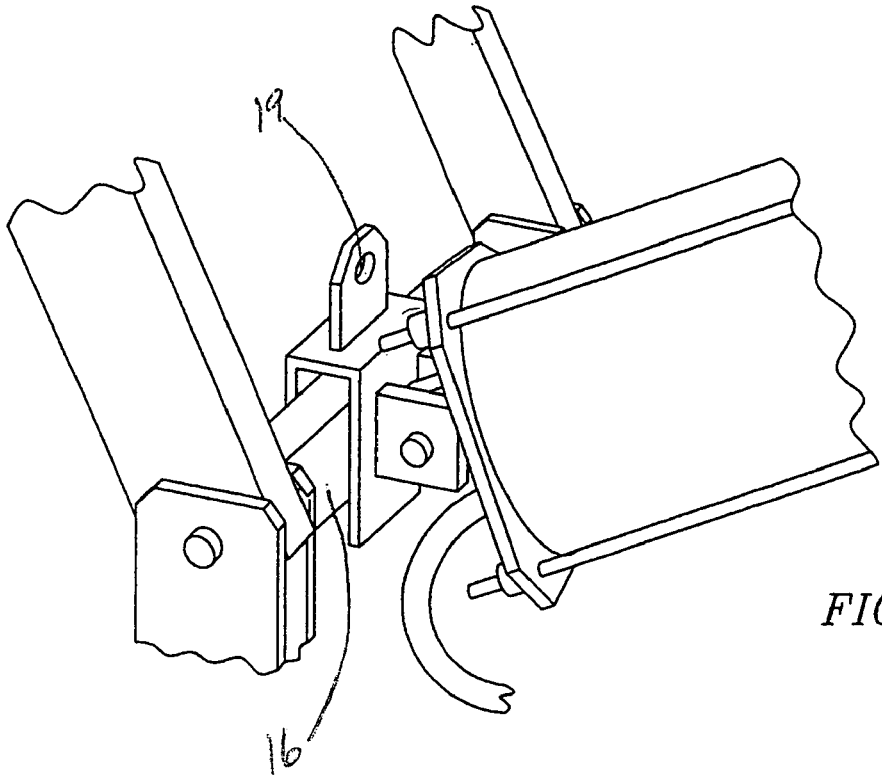
FIG. 5 is a detail perspective view of a portion of the supporting framework of the invention fitted with a lifting eye for adjusting the elevation of the framework.
Figure 6:
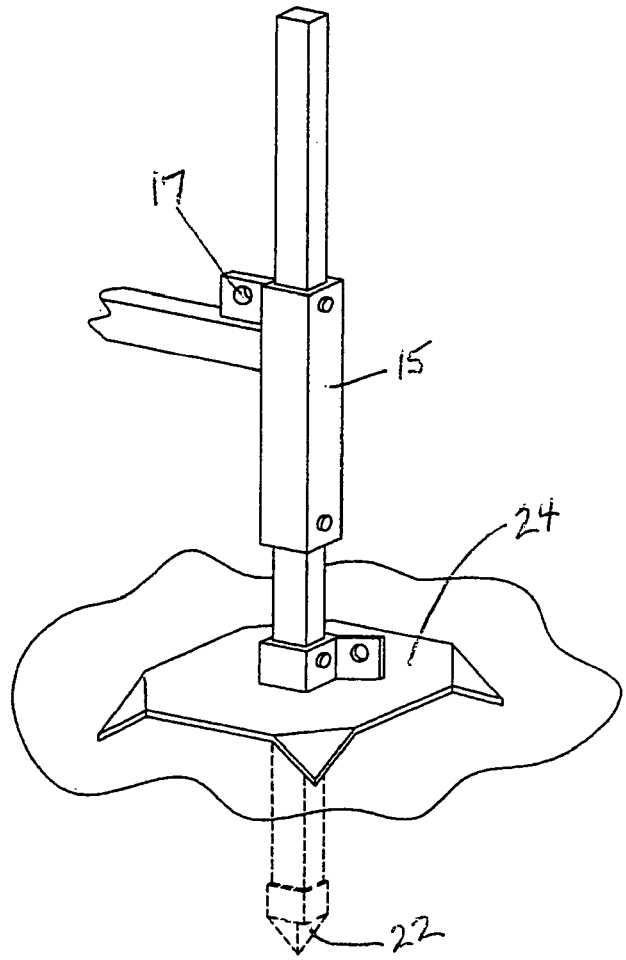
FIG. 6 is a detail perspective view of one of four vertical support posts with lifting eyes to adjust the elevation of the lifting mechanism of the invention.
Figure 7:
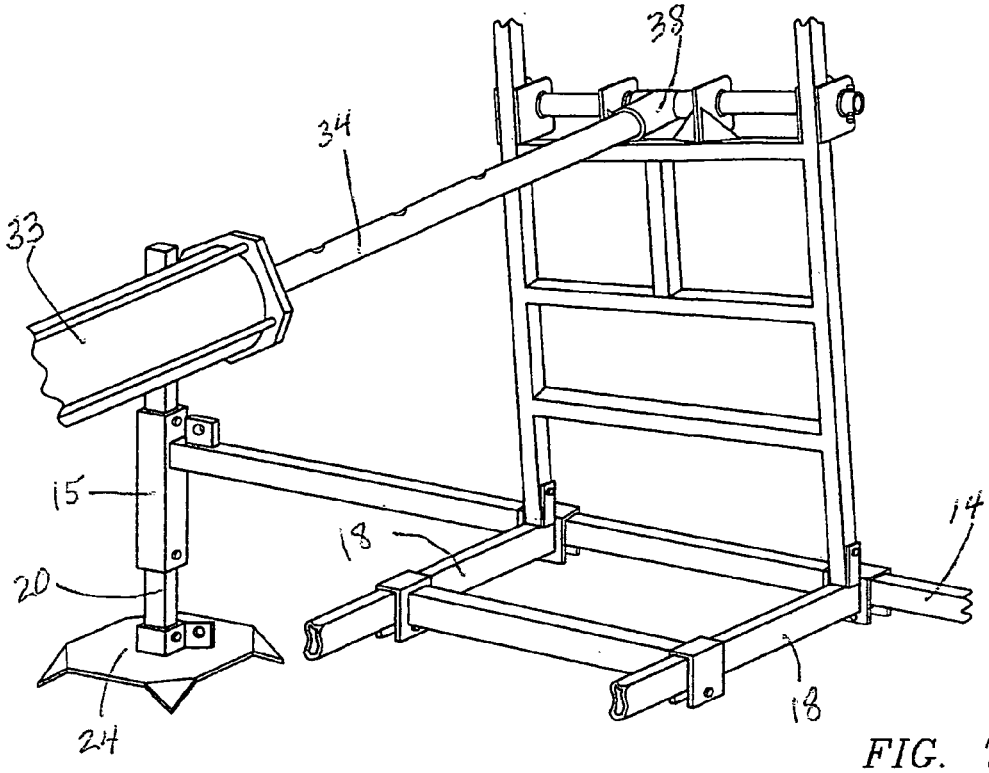
FIG. 7 is a detail perspective view of one of the pair of swingable lifting frames raised by the extended hydraulic piston.
Figure 8:
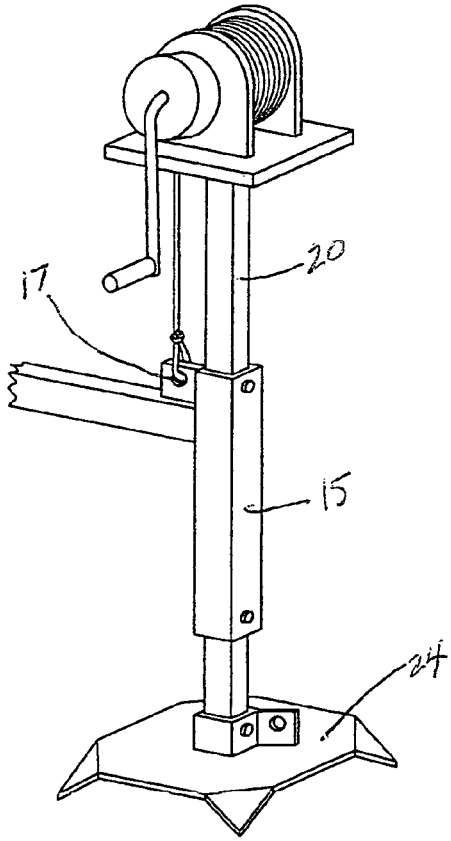
FIG. 8 is a detail perspective view of one of the supporting vertical legs with a winch connected to a lifting eye on a crossbeam of the base framework.

Crossbeams 14 and 16 terminate in sleeves 15 which are slidable up or down on legs 20, allowing for adjustment of the elevation of the boatlift depending on varying levels of water depth. FIG. 6 shows eyes 17 on sleeves 15 which permit attachment of tackle and use of a winch, as shown in FIG. 8, to assist in lifting or lowering framework 12. Lifting eyes 19 may also be provided on crossbeams 16 and 14, as shown in FIG. 5. Legs 20 are preferably pointed at their bottoms 22 to better penetrate the ground under the body of water. Plate-like feet 24 are adjustably mounted on legs 20, as shown in FIG. 6, to prevent the invention from sinking into a soft muddy bottom.

Figure 3:
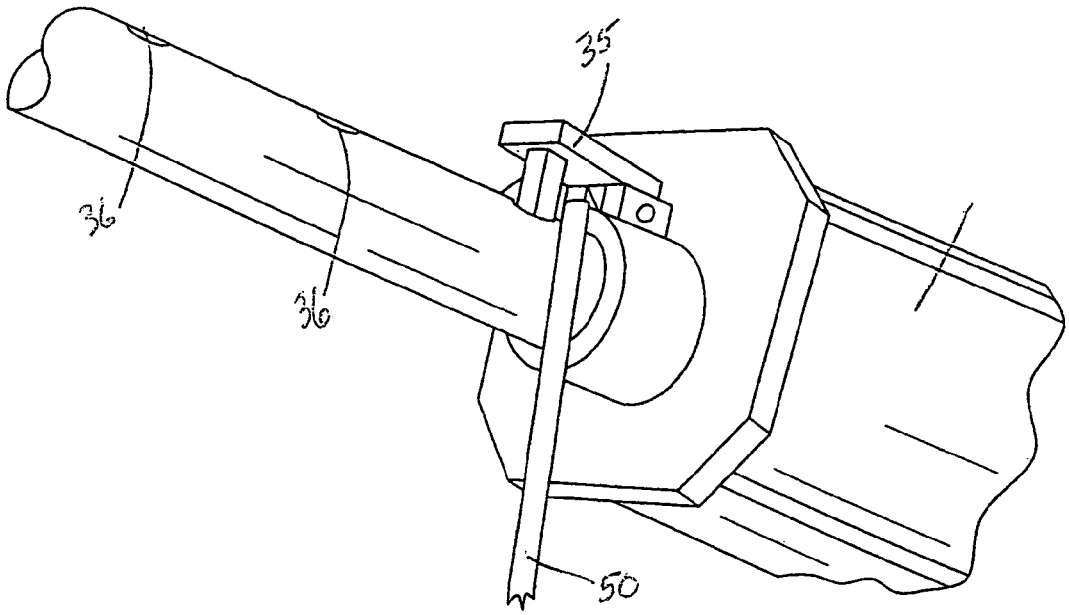
FIG. 3 is a detail perspective view of the locking mechanism on the hydraulic cylinder jack of the invention, in the locked position.
Figure 4:
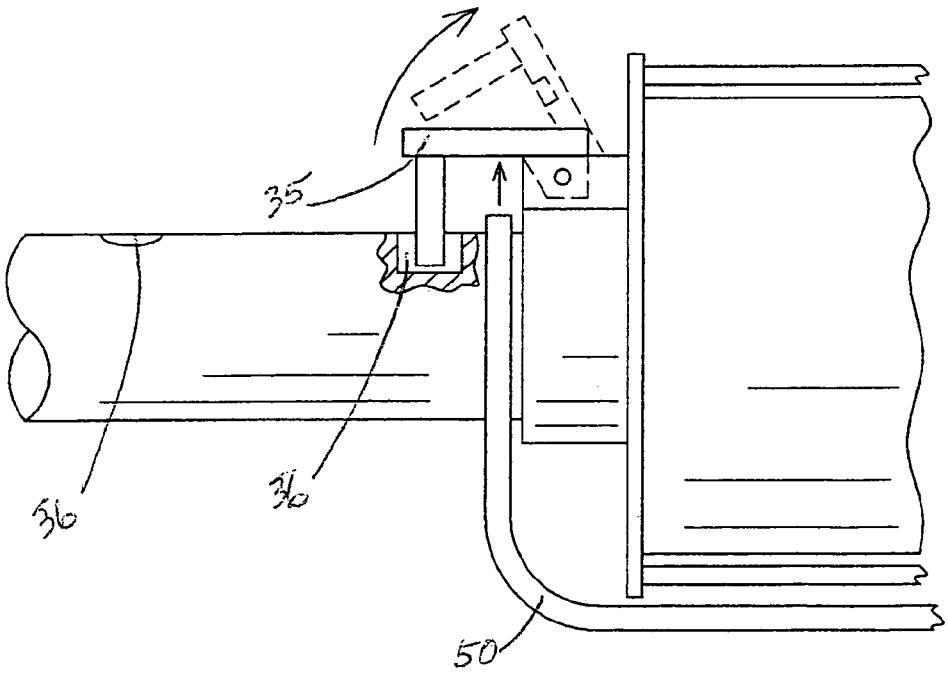
FIG. 4 is an elevational view of the locking mechanism in its locked position with the unlocked position shown in phantom, and including a sectional view of a recess in the piston shaft.

A locking mechanism provides protection against lowering of the lifting frameworks 30 and 32, whether accidentally or intentionally by a potential thief, by preventing retraction of the piston 34 into the cylinder 33. This is accomplished by a pawl member 35 pivotably mounted on cylinder 33, as shown in FIGS. 3 and 4. Pawl member 35 falls by force of gravity into one of a plurality of apertures 36 in piston 34 when the latter is extended. Pawl member 35 is forced out of aperture 36 by water pressure from hose 50; it is necessary to simultaneously apply water pressure to advance piston 34 in order to dislodge pawl member 35. In order for the system to be theft-proof, access to the supply of water must be restricted.

A safety feature of this invention, intended to prevent nighttime collisions, is the incorporation of phosphorescent reflector strips 11 routed into the plastic lumber of the cradle member 40.

What is claimed is:

1. In a hydraulic boat lift having a submerged elongate base frame including adjustable vertical legs with adjustable feet, forward and aft cross beam members, transversely spaced longitudinal beams fixedly joining said cross beam members, swingable parallel elongate boat lifting frames pivotally mounted at their lower ends to the forward and aft ends of the longitudinal beams where they join the cross beam members, a boat cradle pivotably attached to said lifting frames at their upper ends, said boat cradle extending generally parallel to the base frame, such base frame, lifting frames and boat cradle forming an approximate parallelogram, hydraulic jack means extending generally diagonally of such parallelogram for swinging the lifting frames relative to the base frame so as to elevate the boat cradle and a boat resting thereon, said jack means comprising a cylinder assembly containing a piston assembly with a piston shaft provided with a plurality of spaced apart recesses, said piston shaft entering into said cylinder assembly, and a locking pawl which by gravity engages one said recess to prevent the piston shaft from retracting into the cylinder assembly when the boat cradle is elevated, the improvement comprising:

said locking pawl being generally L-shaped, one leg thereof being pivotably mounted on said cylinder assembly adjacent said piston shaft and having an inner surface, said pawl being removable from an engaged recess on the piston shaft by directing water pressure upward through a conduit adjacent said piston shaft at the inner surface of said pivotably mounted leg.

2. The improvement of claim 1, further comprising:

each crossbeam being slidably attached to said vertical legs for adjusting the height of the boat lift to compensate for variations in water levels.

3. The improvement of claim 2, further comprising:

a plurality of adjustable vertical stops whereby the boat cradle is prevented from being lowered below a selected depth under water.

4. The improvement of claim 3 further comprising:

phosphorescent reflector strips on the sides of the boat cradle.

5. The improvement of claim 4 wherein the feet are toothed so as to engage a lake bottom.

6. The improvement of claim 5 wherein each crossbeam has lifting eyes whereby tackle may be attached to raise or lower the crossbeams on the vertical legs.

* * * * *